US007845787B2

(12) United States Patent
Snyder et al.

(10) Patent No.: US 7,845,787 B2
(45) Date of Patent: Dec. 7, 2010

(54) SYSTEM AND METHOD FOR RESPONDING TO RECORDING MEDIUM CHANGE

(75) Inventors: Trevor J. Snyder, Newberg, OR (US); Cheng-Sung Chan, West Linn, OR (US); Paul J. Woodward, West Linn, OR (US); Russell J. Watt, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 877 days.

(21) Appl. No.: 11/611,902

(22) Filed: Dec. 18, 2006

(65) Prior Publication Data

US 2008/0145074 A1 Jun. 19, 2008

(51) Int. Cl.
*B41J 2/01* (2006.01)

(52) U.S. Cl. ..... 347/103; 347/19

(58) Field of Classification Search ..... 347/103
See application file for complete search history.

(56) References Cited

U.S. PATENT DOCUMENTS 6,016,419 A * 1/2000 Hirai ..... 399/390
6,154,621 A * 11/2000 Yamamoto et al. ..... 399/68
6,400,912 B1 * 6/2002 Tanaka et al. ..... 399/45
7,360,887 B2 * 4/2008 Konno ..... 347/103

* cited by examiner

*Primary Examiner*—Matthew Luu
*Assistant Examiner*—Brian J Goldberg
(74) *Attorney, Agent, or Firm*—Michael J. Nickerson; Basch & Nickerson LLP

(57) ABSTRACT

A print system senses the type of a recording medium. The print system modifies the amount of marking material on an imaging drum when the sensed the recording medium type requires a modification to the amount of marking material on the imaging drum. Moreover, the print system changes a transfix parameter when the sensed the recording medium type requires a modification to the transfix parameter.

12 Claims, 2 Drawing Sheets

SYSTEM AND METHOD FOR RESPONDING TO RECORDING MEDIUM CHANGE

BACKGROUND

A conventional high speed printer has limited ability to change print modes during the printing process while retaining the ability to produce printed recording medium at a high rate of sheets per minute. This limited flexibility is a problem when a desired print job must contain a variety of print recording medium types where different recording medium types require a change in imaging or printing parameters. The high rate of sheets per minute creates a situation where the image to be printed may already be on the imaging drum before a print recording medium sensor can sense the type of recording medium upon which the image is to be printed.

The ability to print in various modes is a conventional printer feature. For example, a printer user may be presented with mode choices such as: draft, fast color, enhanced color, or photograph. Further, a conventional printer may provide recording medium settings such as: paper or transparency. Any of these settings may be selected by the user at some point in the process of setting up a print job.

The proper combination of settings produces the best image vibrancy and durability for the print medium being used. For example, in a solid ink color printer, different amounts of ink are needed depending on the background color of the print recording medium. Conventionally, more coverage is needed (requiring more ink) for a transparency since light will penetrate the transparency to produce the image. On the other hand, white paper provides a reflecting background and the appropriate color gamut can be generated with much less ink coverage compared to that needed with a transparency.

A problem arises when a setting selected by a user is incompatible with the actual print medium that is being used. For example, a user may desire to print a paper set of transparencies so as to be distributed to the attendees of a presentation. However, instead of using the printer driver, most customers choose to just insert the transparencies into the printer and print as if it was a paper job. This causes the job to print in paper mode vs. transparency mode, which results in an unnecessary degradation in print quality.

Another example of a problem of a setting selected by a user being incompatible with the actual print medium is the printing of an image on photographic paper. As noted above, human error, due to a failure to change the mode of the printer to a photographic paper mode, may cause the printing of the image in paper mode rather than photographic paper mode, thereby resulting in an unnecessary degradation in print quality.

Therefore, it is desirable to provide a print system wherein instead of having the user program the recording medium mode settings, a user only needs to load the recording medium into the printer and the proper mode is automatically used to print on the job. Moreover, it is desirable to provide a printer that senses the type of recording medium being used, and based upon the sensed recording medium type adjust parameters of the printing process; e.g., adjusting the image already on the imaging drum; adjusting the transfer properties such as the transfix speed (velocity), drum temperature, media preheat temperature, or nip pressure; adjusting ink coverage; adjusting the amount of marking material used to render the image; and/or adjusting the drum's electrical parameters, etc.

BRIEF DESCRIPTION OF THE DRAWINGS

The drawings are only for purposes of illustrating an embodiment and is not to be construed as limiting, wherein.

DETAILED DESCRIPTION

Figure 1:
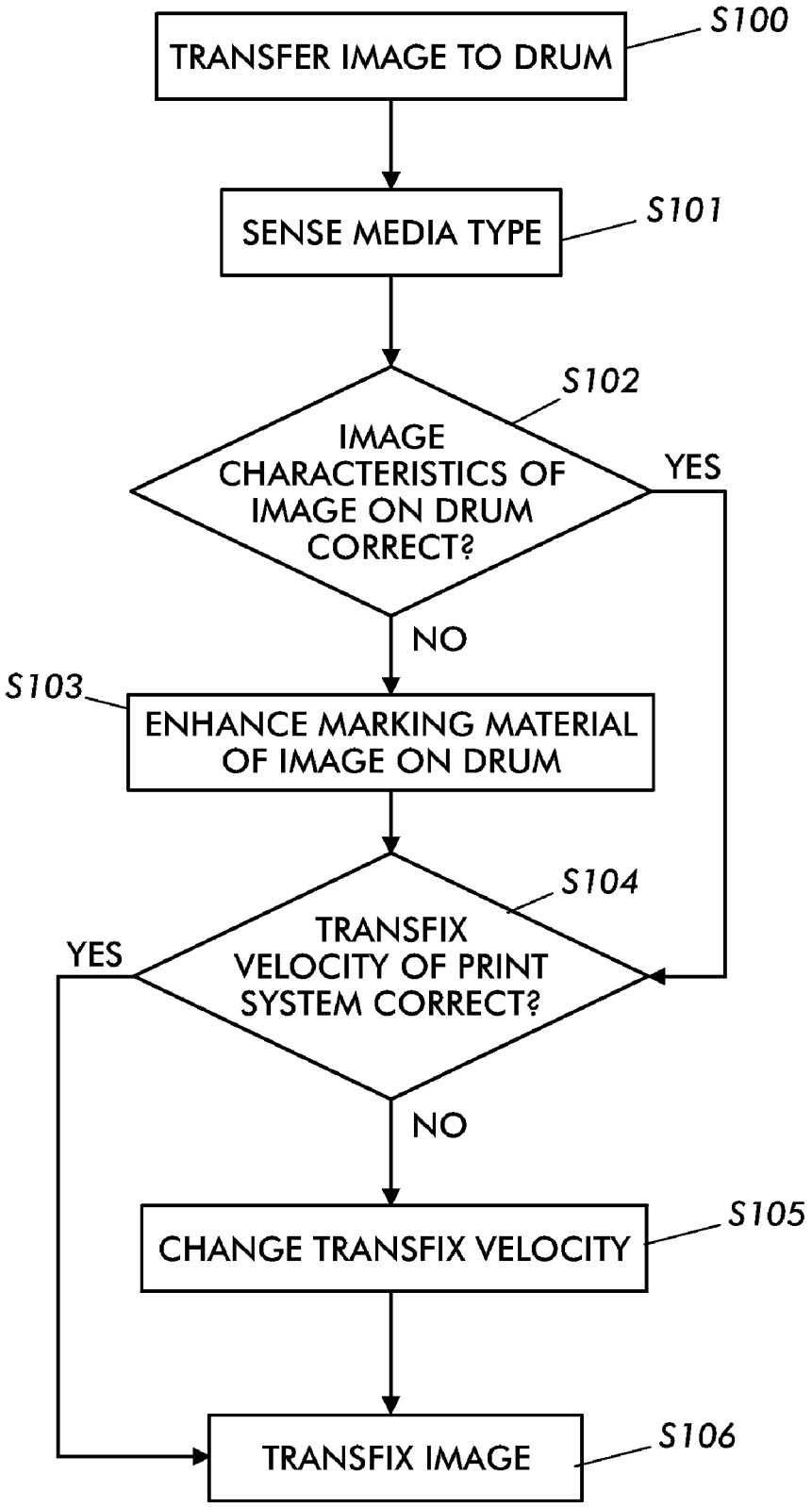
FIG. 1 is a flowchart illustrating responding to recording medium loaded in a printer and establishing a proper recording medium mode accordingly.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

As noted above, it is desirable to provide a print system wherein instead of having the user program the recording medium mode settings, a user only needs to load the recording medium into the printer and the proper mode is automatically used to print on the job. Moreover, it is desirable to provide a printer that senses the type of recording medium being used, and based upon the sensed recording medium type adjust parameters of the printing process; e.g., adjusting the image already on the imaging drum; adjusting the transfer properties such as the transfix speed (velocity), drum temperature, media preheat temperature, or nip pressure; adjusting ink coverage; adjusting the amount of marking material used to render the image; and/or adjusting the drum's electrical parameters, etc.

FIG. 1 illustrates a flowchart that demonstrates a specific example of a method that enables a print system to respond to recording medium loaded in the printer and establish the proper recording medium mode. As illustrated in FIG. 1, at step S100, an image is transferred to an imaging drum via a print head. The image may be transferred by any conventional means. For example, solid ink may be jetted onto the imaging drum or toner may be deposited onto the imaging drum and/or belt. A recording medium type sensor detects the recording medium type as the recording medium is fed through the recording medium path at step S101.

In the specific example of FIG. 1, at step S102, the image characteristics of the image on the imaging drum are compared with the sensed recording medium type. If the characteristics of the image on the imaging drum do not match the requirements of the sensed recording medium type, the marking material of the image on the imaging drum is enhanced at step S103. In the example shown by FIG. 1, if the characteristics of the image on the imaging drum match the requirements of the sensed recording medium type, the transfix velocity of the print system is compared with the transfix velocity required by the sensed recording medium type at step S104.

If the transfix velocity does not match the transfix velocity required by the sensed recording medium type, the velocity of the transfix roller is adjusted to match the transfix velocity required by the sensed recording medium type at step S105. If the transfix velocity does match the transfix velocity required by the sensed recording medium type, the image is transfixed to the recording medium at step S106.

As noted above, FIG. 1 illustrates a specific example. However, the concepts thereof are applicable to other parameters of the printing process. More specifically, upon sensing the type of a recording medium, if it is determined that a predetermined parameter of the printing system required for the sensed recording medium type does not equal a current predetermined parameter of the printing system, the current predetermined parameter of the printing system is modified. In other words, if the characteristics of the printing process do not match the requirements of the printing process for the sensed recording medium type, the print process parameters will be adjusted. The modification of the parameters of the printing system may be invoked when the partial image on the drum is correct, but the print process needs modified; when the image on the drum needs changed, but the print process is correct; and/or when both the image on the drum and the print process need modification.

With respect to enhancing the marking material of the image on the imaging drum, a print system may be required to increase the amount of marking material on the imaging drum to a level required for the recording medium type. For example, if the sensed recording medium type is transparency and the image characteristics of the image on the imaging drum correspond to a recording medium type of paper, the print system will change the image on the drum. One such thing would be to increase the amount of marking material on the imaging drum to a level appropriate for a transparency. It is noted that if the sensed recording medium type is transparency and the image characteristics of the image on the imaging drum correspond to a recording medium type of paper, the print system may also adjust the drum temperature, adjust ink coverage, adjust the drum's electrical parameters, and/or adjust exposure properties, depending on the type of printing system being utilized the necessary adjustment needed to bring the state of the printing system into conformance with the sensed recording medium type.

It is noted that a solid ink print system can increase the amount of marking material on the imaging drum by simply subjecting the imaging drum to more depositions of solid ink through more drum revolutions of the imaging drum thereon. Moreover, it is noted a xerographic print system can increase the amount of marking material on the imaging drum by simply subjecting the imaging drum to a second imaging and development of the latent image with toner. It is also noted that a sub-pixel increment may be used for the second pass.

It is noted that in order to increase the amount of marking material on the imaging drum, it is necessary for the print system to retain the image until the marking material of the image is finally enhanced.

It is further noted that by enhancing the amount of the marking material of the image, the imaging drum may require the arresting or slowing of the movement of the recording medium.

Figure 2:
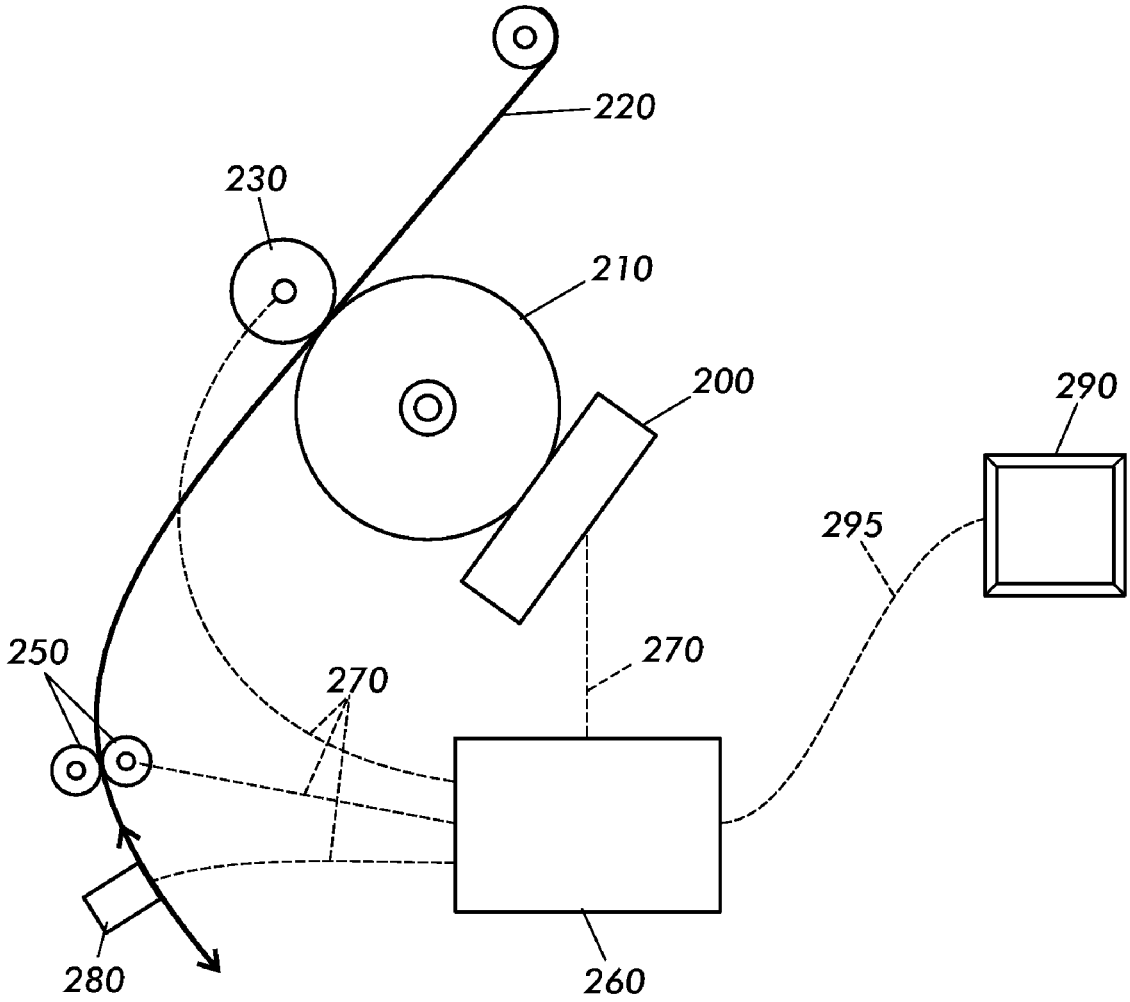
FIG. 2 is a block diagram of a print system.

FIG. 2 illustrates a solid ink print system. As illustrated in FIG. 2, as the recording medium enters the recording medium path 220, the recording medium passes a recording medium type sensor 280. A printer control unit 260 controls the functions of recording medium control rollers 250, the transfix roller 230, and the print head 200. The printer control unit 260 communicates with the various devices of the print system via communication channels 270. An imaging drum 210 receives solid ink in the form of an image.

It is noted that although FIG. 2 illustrates a solid ink print system, the concepts of FIGS. 1 and 2 are readily applicable to a xerographic printer using toner or an inkjet printer.

The recording medium control rollers 250 are used to control the motion of the recording medium in the recording medium path 220, and along with the drum or belt 210, can be modified to arrest the motion of the recording medium or slow the motion of the recording medium. The drum or belt 210 can be modified to allow for enhancing the amount of marking material on the imaging drum 210 as described above. The transfix roller 230 applies pressure to the recording medium to cause the image from the imaging drum 210 to the recording medium. The print head 200 is responsible for transmitting the solid ink to the imaging drum 210. It is noted that in color xerography, the imaging drum 210 may receive the marking material of each color layer from different belts containing different color toners and the transfer to paper would be an electrostatic process.

The user interface 290 communicates with the print control unit 260 via a communication channel 295. The user interface 290 can be used to toggle the print system between an auto sensing mode; the auto sensing mode including the recording medium type being sensed, the amount of marking material on the imaging drum being adjusted based upon the sensed recording medium type and/or the transfix being adjusted speed based upon the sensed recording medium type; and a manual mode wherein a user may override the normal settings for a particular recording medium type.

In one example, the printing system prepares a marking material image for rendering onto a paper based recording medium. Thereafter, the printing system senses a transparency based recording medium in lieu of a paper based recording medium. In response to the sensed transparency based recording medium, the printing system overlays another marking material image for rendering onto a paper based recording medium such that the drum used to transfer the marking material to the recording medium has thereon the equivalent of two marking material images for rendering onto a paper based recording medium.

In another example, the printing prepares a default marking material image. Thereafter, the printing system senses the type of recording medium. In response to the sensed type of recording medium, the printing system overlays additional marking material so as to enable rendering onto the sensed type of recording medium.

In a third example, if a transparency is detected and part or all of a paper image is already on the drum, the printer adds more ink to the drum and decreases the transfix velocity during transfix to make a high quality transparency print.

In summary, a print system senses the type of a recording medium and modifies the amount of marking material on the imaging drum when the sensed the recording medium type requires a modification of the parameters of the printing process. The print system may also, when the sensed the recording medium type requires a modification to the parameters of the printing process, adjust the image already on the imaging drum, adjust the transfer properties (such as the transfix speed (velocity), drum temperature, media preheat temperature, or nip pressure), adjust ink coverage, adjust the amount of marking material used to render the image, and/or adjust the drum's electrical parameters.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for sensing a recording medium type in a printing system and having a response thereto, comprising:

(a) applying an amount of marking material on an imaging drum of the printing system, the amount of marking material corresponding to a pre-determined type of recording medium;

(b) sensing a type of a recording medium to be used by the printing system to render an image;

(c) determining if an amount of marking material required for the sensed recording medium type equals the amount of marking material on the imaging drum; and (d) modifying the amount of marking material on the imaging drum when it is determined that the amount of marking material required for the sensed recording medium type is not equal to the amount of marking material on the imaging drum.

2. The method as claimed in claim 1, further comprising:

(e) determining if a transfix velocity required for the sensed recording medium type equals a predetermined transfix velocity for the printing system, the predetermined transfix velocity corresponding to the pre-determined type of recording medium; and (f) modifying the predetermined transfix velocity when it is determined that the transfix velocity required for the sensed recording medium type is not equal to the predetermined transfix velocity of the printing system.

3. The method as claimed in claim 1, further comprising:

(e) arresting a movement of the recording medium when it is determined that the amount of marking material required for the sensed recording medium type is not equal to the amount of marking material on the imaging drum.

4. The method as claimed in claim 1, further comprising:

(e) slowing the motion of the recording medium when it is determined that the amount of marking material required for the sensed recording medium type is not equal to the amount of marking material on the imaging drum.

5. The method as claimed in claim 1, wherein the sensed recording medium type is a transparent medium and the predetermined type of recording medium is a paper recording medium.

6. The method as claimed in claim 1, wherein the sensed recording medium type is photograph paper and the predetermined type of recording medium is a paper recording medium.

7. A print system, comprising:

a recording medium type sensor to sense the type of a recording medium;

an imaging drum;

a marking material deposition system for applying marking material to said imaging drum; and a controller operatively connected to said recording medium type sensor and said marking material deposition system;

said controller determining from said marking material deposition system an amount of marking material having been applied to said imaging drum, the amount of marking material having been applied to said imaging drum corresponding to a pre-determined type of recording medium;

said controller determining if an amount of marking material required for rendering an image on the sensed recording medium type equals the amount of marking material having been applied to said imaging drum;

said controller causing said marking material deposition system to modify the amount of marking material on the imaging drum when said controller determines that the amount of marking material required for rendering the image on the sensed recording medium type is not equal to the amount of marking material having been applied to said imaging drum.

8. The print system as claimed in claim 7, wherein said controller determines if a transfix velocity required for the sensed recording medium type equals a predetermined transfix velocity of the printing system, the predetermined transfix velocity corresponding to the pre-determined type of recording medium;

said controller modifying the predetermined transfix velocity when the transfix velocity required for the sensed recording medium type is not equal to the predetermined transfix velocity of the printing system.

9. The print system as claimed in claim 7, wherein said controller causes a movement of the recording medium to be arrested when said controller determines that the amount of marking material required for rendering the image on the sensed recording medium type is not equal to the amount of marking material having been applied to said imaging drum.

10. The print system as claimed in claim 7, wherein said controller causes the motion of the recording medium to be slowed when said controller determines that the amount of marking material required for rendering the image on the sensed recording medium type is not equal to the amount of marking material having been applied to said imaging drum.

11. The print system as claimed in claim 7, wherein the sensed recording medium type is a transparent medium and the pre-determined type of recording medium is a paper recording medium.

12. The print system as claimed in claim 7, wherein the sensed recording medium type is photograph paper and the pre-determined type of recording medium is a paper recording medium.

* * * * *